US005598922A

United States Patent [19]

Good

[11] Patent Number: 5,598,922

[45] Date of Patent: Feb. 4, 1997

[54] PRODUCT DISPLAY HANGER

[75] Inventor: David M. Good, Peachtree City, Ga.

[73] Assignee: Voxcom, Inc., Peachtree City, Ga.

[21] Appl. No.: 517,346

[22] Filed: Aug. 21, 1995

[51] Int. Cl.[6] ..... B65D 85/18; A41D 27/22

[52] U.S. Cl. ..... 206/299; 206/281; 206/288; 206/460; 206/806; 223/87; 229/87.15

[58] Field of Search ..... 206/278, 281, 206/284, 288, 289, 297, 299, 460, 495, 806; 229/117.18, 87.15; 223/87

[56] References Cited

U.S. PATENT DOCUMENTS

| | | | |
|---|---|---|---|
| 1,651,172 | 11/1927 | Youngblood | 206/278 X |
| 2,816,653 | 12/1957 | Sacobi | 229/87.15 X |
| 3,659,704 | 5/1972 | Collura et al. | 206/288 |
| 3,779,449 | 12/1973 | Membrino | 229/66 |
| 4,010,299 | 5/1977 | Hershey, Jr. et al. | 428/44 |
| 4,132,309 | 1/1979 | Shaylor | 206/278 |
| 4,257,522 | 3/1981 | Thorneburg | 206/299 |
| 5,021,274 | 6/1991 | Beck et al. | 428/41 |
| 5,030,491 | 7/1991 | Shoesmith | 428/41 |
| 5,469,959 | 11/1995 | Gummer | 206/229 |
| 5,503,269 | 4/1996 | DeBiasio | 206/296 |
| 5,515,966 | 5/1996 | Hodge et al. | 206/292 |

*Primary Examiner*—Bryon P. Gehman
*Attorney, Agent, or Firm*—Frank A. Lukasik

[57] ABSTRACT

The invention is a printed product hanger construction to be used in packaging fabric products especially multiple pairs of socks. The invention consists of a pressure sensitive band that wraps two pairs of socks on one side of a hanger portion and one pair of socks on the other side of the hanger portion. Pressure sensitive adhesive adheres to the socks, thus securing them to the package. A hanger portion of the band protrudes above the remainder of the band and contains the hanger opening for displaying the socks on a pegboard. The hanging region has an opening for receiving a single or a double wire hanger cut near the top of a billboard region containing printed matter.

3 Claims, 6 Drawing Sheets

PRODUCT DISPLAY HANGER

BACKGROUND OF THE INVENTION

1. Field of the Invention

This invention relates generally to product hangers and more specifically to printed product hanger construction to be used in packaging fabric products especially multiple pairs of socks.

2. Discussion of the Prior Art

Hang tags and product hangers are used in large numbers for hanging a wide variety of small products on the wire hangers of sales display racks. The hang tags have an opening, usually in the form of a squat, isosceles triangle, having an apex that can receive a single wire hanger and having a base broad enough to receive a double wire hanger.

Hang tabs are generally adhered to the box or package they support, and are usually formed to fold flat against the package they are adhered to, until the package is removed from a packing case and hung up for sales display.

Labels using pressure sensitive adhesives are well known. In general, pressure sensitive labels involve the label itself, a pressure sensitive adhesive, and a backing sheet upon which the label or labels are mounted. The backing sheet is usually coated with a release coating, such as a silicone, so that the adhesive coated labels may be more readily removed. Various types of adhesives may be used to coat the labels.

Prior art methods of packaging require the product to be packaged in a paperboard box or plastic header bag for display on a hanging rack system. Both of these packaging systems use a considerable amount of material. Prior art packaging generally consists of a wrapper having printed matter describing the product, or a label pasted on a package containing the printed matter. Additionally, a header, having a billboard laminated therein is used to close the top of the package and provides the hanger for a display rack.

One such prior art sock hanger comprises a band of plastic, printed stock, with an inner surface coated with an adhesive. The band is wrapped around three pairs of socks, overlapped and fastened at the opposite end of the band. A swift tab and hanger are then inserted in a sock to provide a hook to suspend the product from a wire hanger. An additional swift tab is used to attach promotional material making a total of five parts to the package.

Several prior art patents include a combination of hanger tags and packaging. U.S. Pat. No. 3,779,449 to Membrino discloses a linear strip of severable bags connected in a strip of severable bags connected in a strip, each bag having a selvage portion, this selvage portion being common to all the bags when in the strip. The bag or bags are connected to the selvage portion by a perforated line. The bag or bags are each provided with an open mouth defined by an upwardly extending portion of the rear wall, this upwardly extending portion forming a lip. Each lip is connected to the selvage portion by means of the perforated line.

U.S. Pat. No. 4,010,299 to Hershey Jr. et al discloses a multi-panel outsert for attachment to a container comprising two or more longitudinal panels closed upon themselves by transverse folds and secured compactly by adhesively joining a spot on the inside of the outer longitudinal panel to an adjacent, outside portion of the outer panel which encloses and secures one or more other panels, affording increase printing area for the outsert with decreased likelihood of loss. An aperture through the panel or panels folded inwardly adjacent the outer panel allows such direct attachment of the outer panel to itself to effect the enclosure and securement.

U.S. Pat. No. 5,030,491 to Shoesmith discloses a self adhesive mounting surface which has adhesive available, upon the removal of a release liner, in order to affix objects including, but not limited to, fabric, paper, plastics, yarn, leather, glass, and trims. The mounting surface is a heavy weight card stock paper, though it may be any material to which self-adhesives can be applied. The release liner, a material specially treated so as to be easily removed from the adhesive, covers the adhesive until it is removed. The object to be mounted on the surface is pressed down on the exposed adhesive, thus securing it to the mounting surface.

U.S. Pat. No. 5,021,274 to Beck et al is included as showing a laminated packaging material and the process for manufacturing the material.

Typically, socks are packaged and displayed by being wrapped with a pressure sensitive or other printed band around the center of the socks. A plastic or similar material hanger is then attached to the socks using a swift tack hanger. This current method has a number of disadvantages. Among these is the fact that multiple, dissimilar components must be used consisting of the band, the hanger, and the swift tack. These dissimilar materials make for difficulty in recycling of the packaging as well as well as requiring multiple steps to assemble the package.

Another current method of packaging socks and other products is a plastic bag with a reinforced header for hanging. This design has many disadvantages including using large amounts of plastic. Additionally, header bags take more space, due to their design, on a display pegboard system.

With the current efforts to reduce the amount of packaging materials used and thus reduce the amount of material reaching landfills, new and more efficient packaging methods are required. The current efforts are to make products and packaging "Green", that is, using a bare minimum of recycled and recyclable materials.

SUMMARY OF THE INVENTION

The present invention provides a less expensive, more efficient, and environmentally acceptable product hanger and method of packaging than any of the prior art methods. Among some of the advantages of the present invention are: an increased display area, the product hanger/band may be constructed of many materials, including but not limited to paper, card stock, and a combination of these materials.Because the entire hanger/band is made of the same material, it can be more easily recycled than the prior art. An additional advantage over the current packaging techniques, is that the band may be supplied on rolls, thus lending itself to automatic application and packaging.

The invention, detailed in the drawings, consists of a pressure sensitive band that wraps the socks. The pressure sensitive adhesive adheres to the socks, thus securing them to the package. A hanger portion of the band protrudes above the remainder of the band and contains the hanger opening for displaying the socks on a pegboard. The hanger portion has an opening, in the form of a squat, isosceles triangle for receiving a single or a double wire hanger located near the top of a billboard region (graphics area) containing printed matter. All of the material can be printed in multiple colors for display purposes.

The hanger band is made from a-continuous web of card stock or other suitable webs of material such as paper and a combination of these materials, by a process including, coating a second side, (back side) with a pressure sensitive adhesive, combining and adhering the continuous web of card stock to a liner, printing graphics on a first side (front side) of the continuous web using a suitable printing process, and die cutting and scoring the hanger band shape and the hanger opening, stripping the waste material from the liner, and rewinding the combined hang tags and liner on a reel for shipment to a customer.

DESCRIPTION OF THE PREFERRED EMBODIMENT

Figure 1:
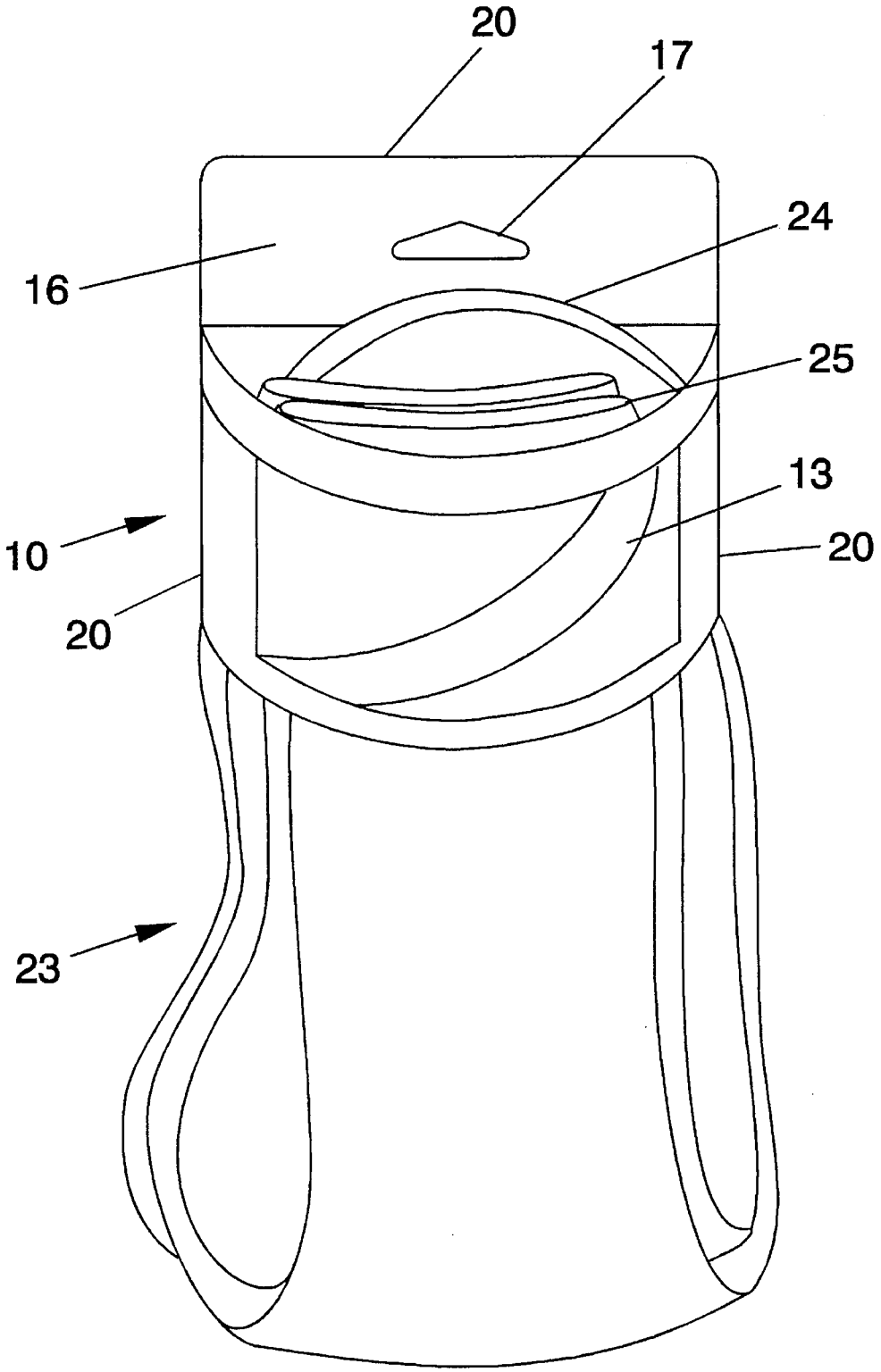
FIG. 1 is a perspective plan view of the product hanger of the invention showing three pairs of socks wrapped for hanging.
Figure 2:
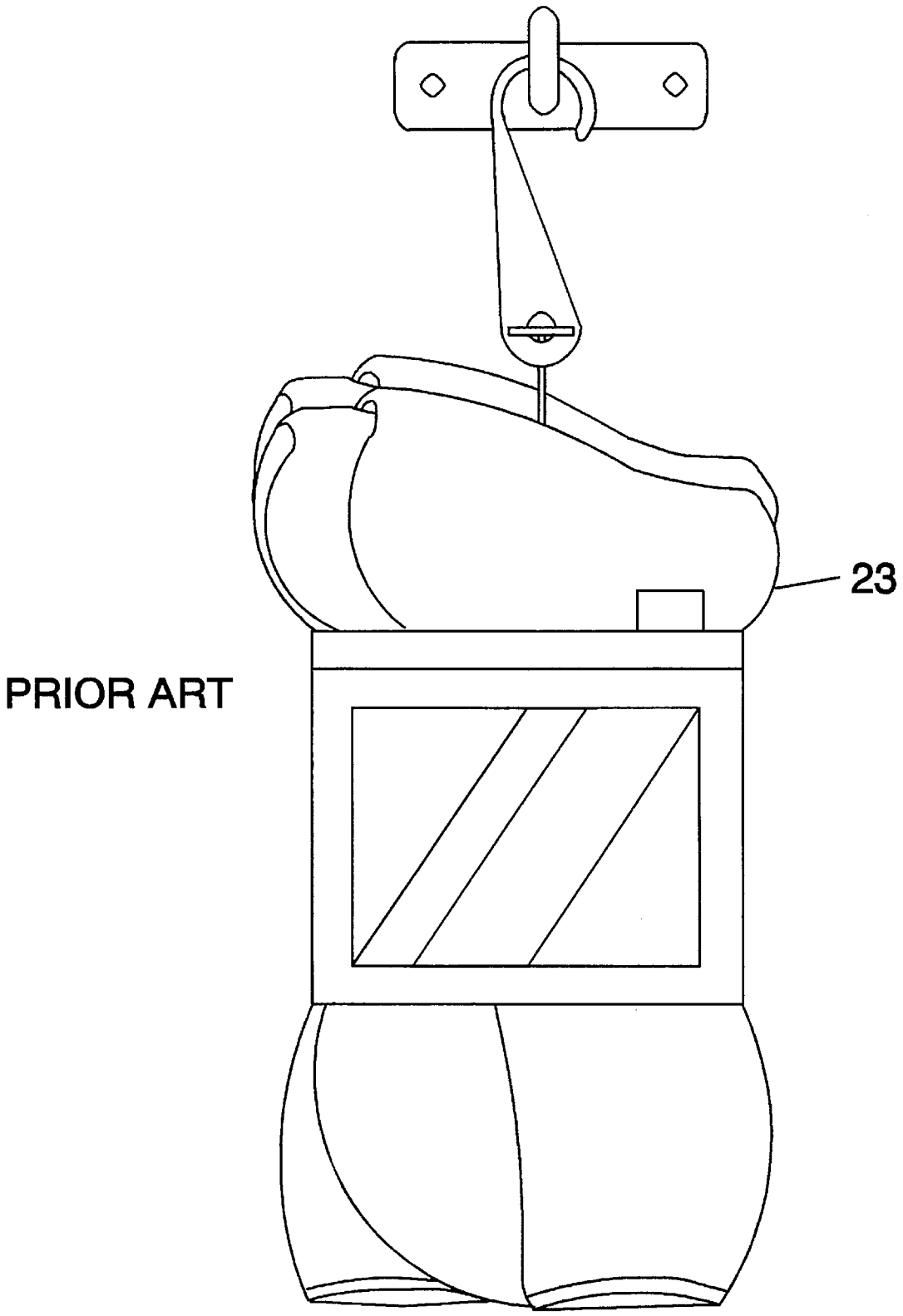
FIG. 2 is a perspective view of a prior art sock hanger.

The product/sock hanger 10 of the invention is preferably formed of a face stock 11 having an adhering region, back side 19, a front side 18, and a hanging region 16 on the upper portion with die cut opening 17 where sock hanger 10 can be hung on single or double wire hangers, and where a billboard containing graphics may be printed for sales display. The cut out portion of die cut opening 17 may remain attached to the release liner by the adhesive to permit removal only when required.

The manufacture of sock hanger 10 according to the invention is accomplished on a multi-color web press and begins with passing a continuous web of face stock 11, through a hot melt adhesive applicator and coating at a back side 19, with a clear, pressure sensitive, adhesive 15. After the adhesive application step is completed, the face stock 11 is combined with release liner 12 between a set of combining rollers, then passed through a first printing section and the advertising or instructional printed matter, multi-color printing 13 is printed on the front side 18. Additional printing sections may be used when more than one color are needed. If transparent stock is used, the advertising and instructional printing 13 may be applied by using reverse image flexographic printing or other suitable printing process.

In the process, the printing 13 is applied to what is regarded as the front side 18. In a preferred embodiment, water soluble inks were used in order to provide a safer work area for the employees in the manufacture of sock hanger 10 and also to manufacture a product that is totally recyclable. The next step passes the printed area through a dryer section. Additional printing and drying stations may be added as desired.

When the printing and drying steps are completed, face stock 11, combined with release liner 12, are then passed through a set of die cut rollers and scoring rollers where the sock hangers 10 are cut to shape. The release liner 12, combined with the sock hanger 10, are then prepared for automatic application in a manner well known in the art.

Figure 3:
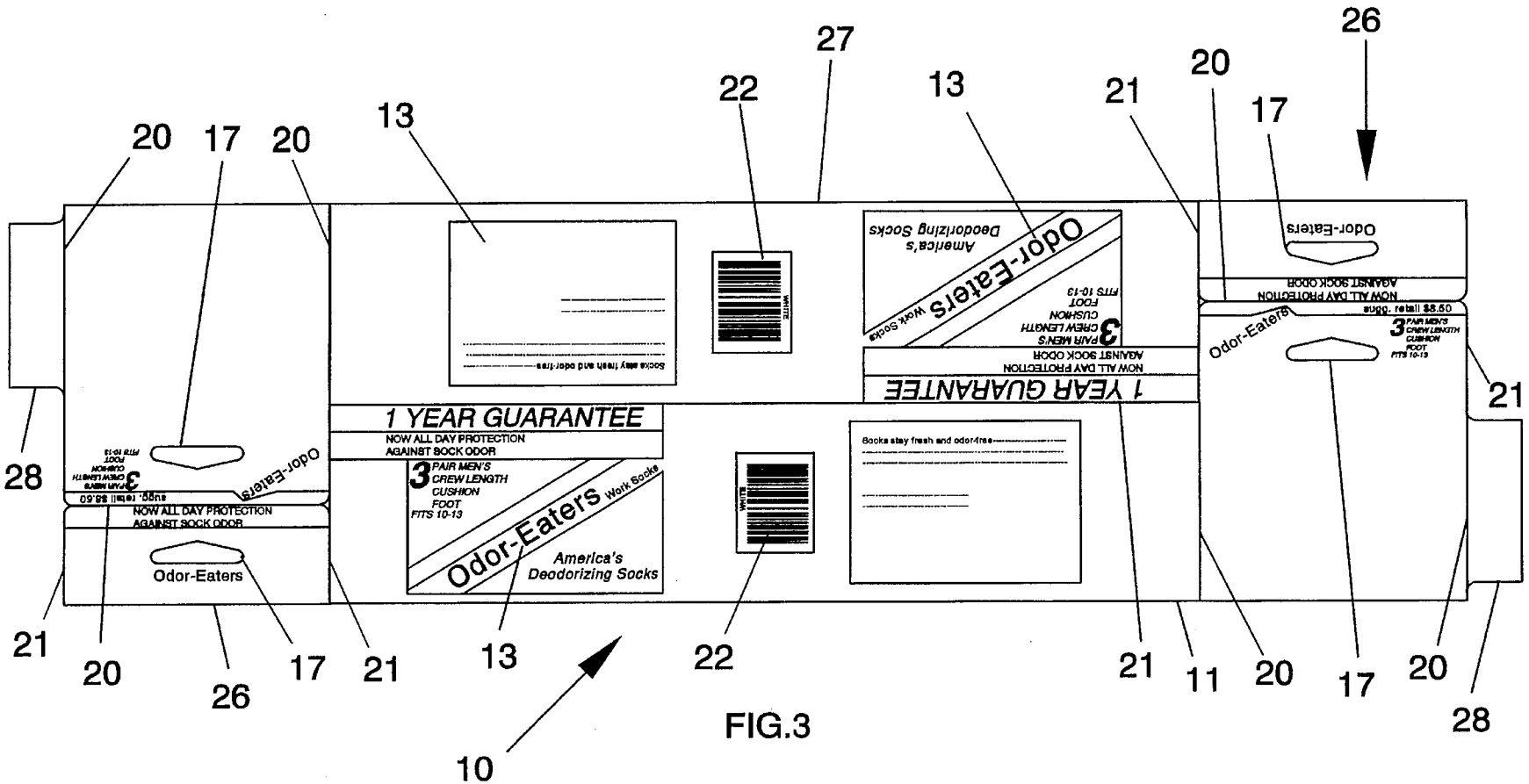
FIG. 3 is a top plan view of the front side of two product hangers showing their relationship in a continuous web.
Figure 4:
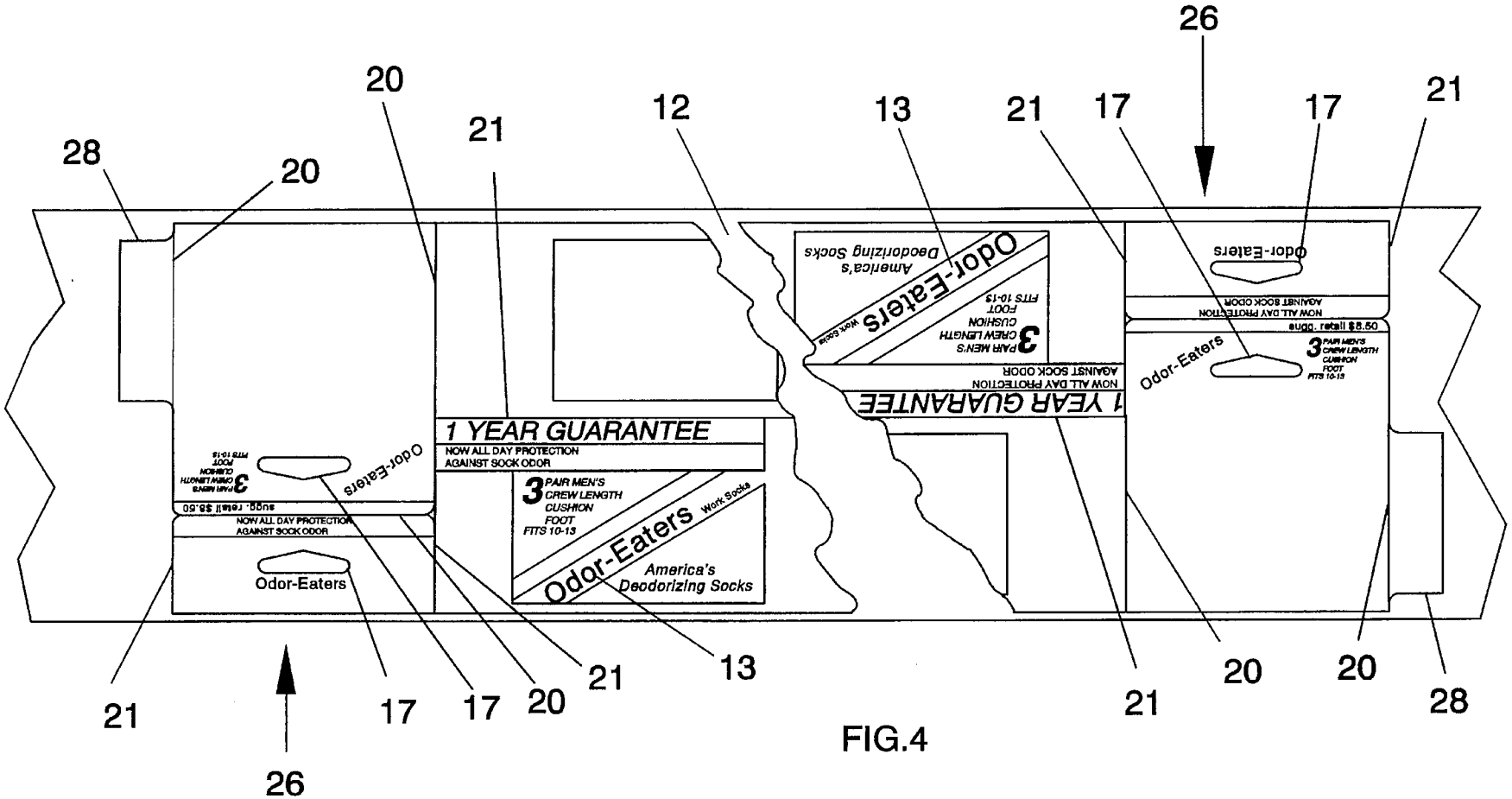
FIG. 4 is a top plan cutaway view of the front side of two product hangers temporarily affixed to a liner.
Figure 5:
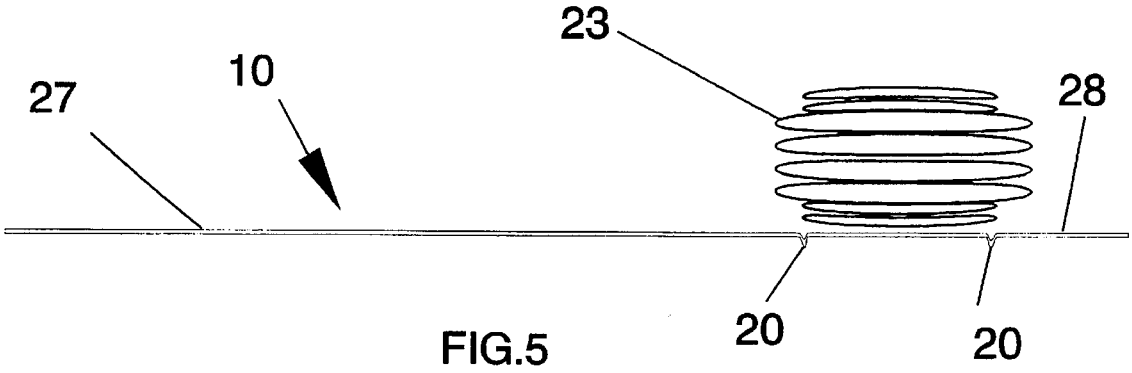
FIG. 5 is a schematic view of the first step of wrapping a product hanger on a pair of folded socks.

Referring to FIGS. 3 and 4, there are shown two sock hangers 10 as they are formed from a flat sheet of face stock 11. Die cuts 21 separate the hanger portion 26 from the wrap portion of sock hangers 10 with a single cut 21 parallel to the face stock 11 web and two perpendicular die cuts 21 perpendicular to the center line of face stock 11. Thus, two sock hangers 10 are formed simultaneously with very little waste material. The die cut openings 17 are similarly cut during the pass of face stock 11 through the press. U.P.C. codes 22 are also printed during the pass through the press.

Hanger portion 26 is scored for folding, as at score lines 20, at a midpoint between the two die cut openings 17 to facilitate the folding and joining of the hanger portion 26, during assembly of the sock hanger 10, and across the wrap portion 27 on a line continuing from die cuts 21, forming hanger portion 26 to facilitate the folding of the tab portion 28 and the wrap portion 27.

Following are the specific details of a preferred embodiment of the invention:

10 Pt. C1S Cardstock/Textile Adhesive/2 Mil PP Liner Facestock 10 pt. Cardstock: clay coated white solid-bleached sulfate paperboard:

FACESTOCK

| Property | Test Method | Typical Value |
|---|---|---|
| Caliper | Micrometer | 10 mil |
| Gloss | ASTM D-2457 | 60 |
| Brightness | Reflection Meter | 84 |
| Tear | TAPPI T 414 | MD 155 gms.<br>CD 165 gms. |
| Stiffness | TAPPI T 803 | MD 40<br>CD 20 |

Adhesive

TX100: Is a high performance pressure sensitive adhesive designed for temporary adhesion to cotton, nylon, and similar fabrics.

| Property | Test Method | Typical Value |
|---|---|---|
| Coat Weight | Weighted Sample | 1.0 mil |
| Tack/Loop | TLMI Loop Tack Test | 160 Grams |
| Tack/Rolling Ball | PSTC 6 | 11 inches |
| 90 Peel/Liner | VOXCOM Peel Test | 37 Grams/inch |
| 90 Peel/Stainless | VOXCOM Peel Test | 400 Grams/inch |

Liner 2.0 mil PP Liner: A silicone coated biaxilly oriented polypropylene film that exhibits consistent release properties and is estremely resistant to tearing and breaking.

| Property | Test Method | Typical Value |
|---|---|---|
| Standard Guage | Micrometer | 2.0 mil |
| Tensile Strength | ASTM D-882 | MD 14,500 lbs./Sq. in.<br>TD 33,000 lbs./Sq. in. |
| Elongation | ASTM D-882 | MD 190%<br>TD 35% |
| Yield | Weighted Sample | 15,300 Sq. In./lb. |
| Haze, Gardner | ASTM D-1003 | 3.0% |
| Release | Mobil #S-03 | 15–40 GM/In. Width |

The assembly of sock hanger 10 begins with folding the first part of hanger portion 26 over score line 20, joining the two parts as a reinforced, double thickness hanger, with the two die cut openings 17 aligned for double strength.

Figure 6:
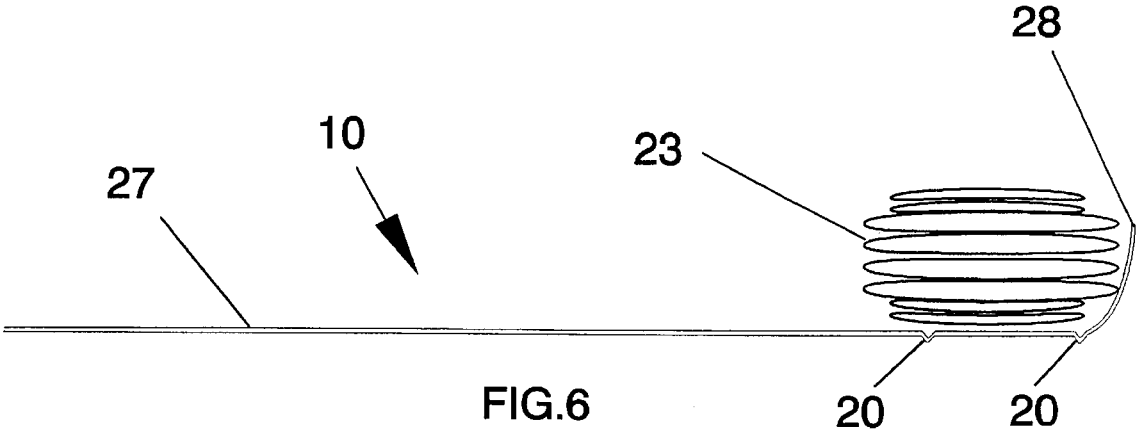
FIG. 6 is a schematic view of the second step of wrapping a product hanger on a pair of folded socks showing a first end bent upwardly.
Figure 7:
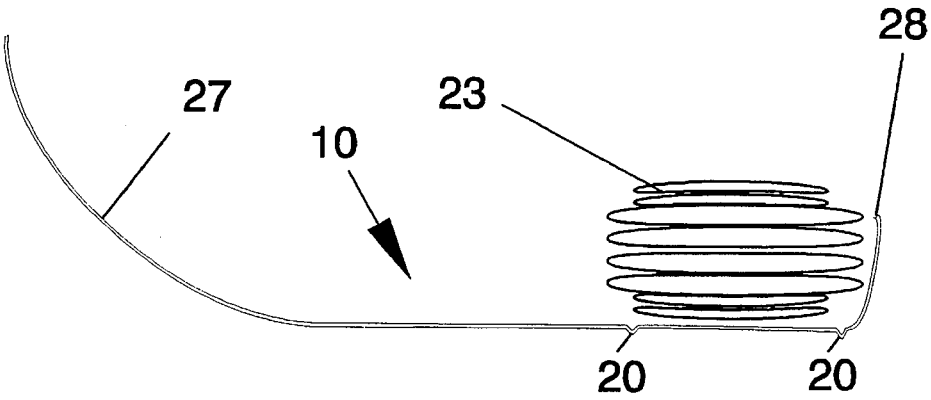
FIG. 7 is a schematic view of the third step of wrapping a product hanger on a pair of folded socks showing a second end being bent upwardly.
Figure 8:
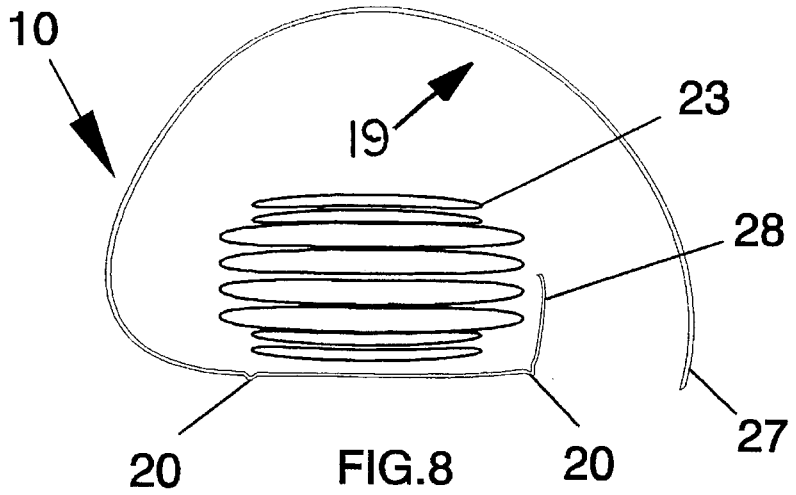
FIG. 8 is a schematic view of the fourth step of wrapping a product hanger on a pair of folded socks showing the product hanger being wrapped around the two pair of socks.
Figure 9:
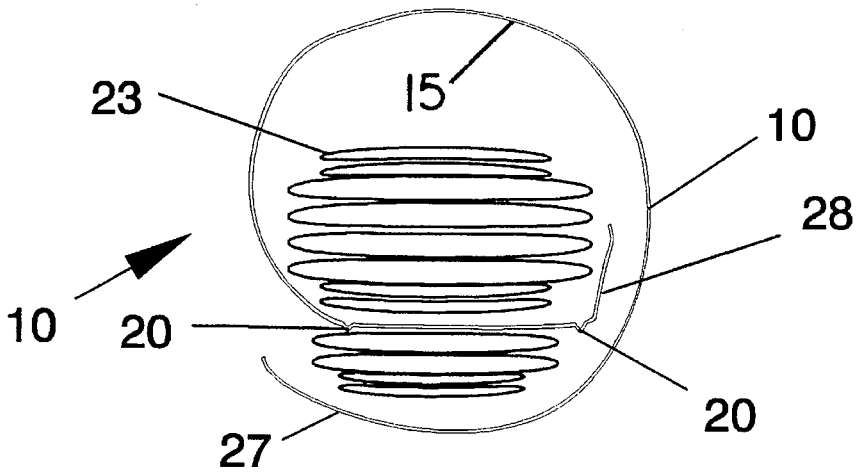
FIG. 9 is a schematic view of the fifth step of wrapping a product hanger on a third pair of folded socks.
Figure 10:
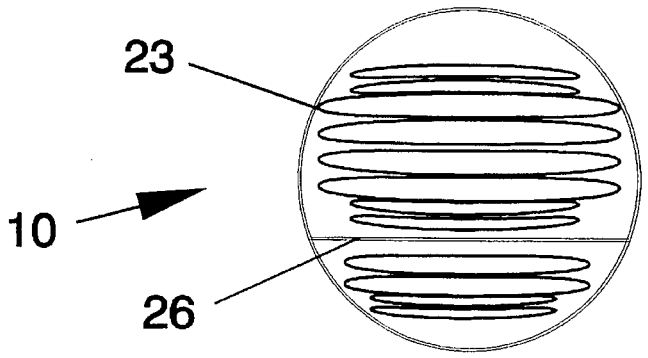
FIG. 10 is a schematic view of the hanger/band product hanger of the invention showing the product hanger wrapped around and holding three pairs of socks.

FIGS. 5 through 10 show the various steps involved in folding sock hanger 10 while wrapping a product consisting of three pairs of men's socks 23. Starting with FIG. 5, there is shown, sock hanger 10, with hanger portion 26 lying on a flat surface and two pairs of socks 23 placed between the two score lines 20 on each side of hanger portion 26. FIG. 6 shows tab portion 28 being folded up to contact the socks 23. FIG. 7 shows the sock hanger 10, with wrap portion 27 being bent to begin the wrapping process of the invention. FIG. 8 shows wrap portion 27 continuing to encircle the three pairs of socks 23. FIG. 9 shows the wrap portion 27 completely encircling the socks 23 prior to sealing the entire package as shown in FIG. 10 with wrap portion 27 being adhered at its opposite end.

The high performance, pressure sensitive adhesive 15 is designed for temporary adhesion to cotton, nylon, and similar fabrics. When a customer wishes to open the sock hanger 10, the customer need only reverse the process to remove the socks 23. While the socks 23 are encircled by the sock hanger 10, it is very difficult to remove one or more of the socks 23 without destroying the sock hanger 10.

In summary, the instant invention has been designed to provide all of the required characteristics of sound packaging and product display while providing an economical, effective, packaging and advertising medium which utilizes recycled materials and is recyclable itself. The invention is recyclable because of the unique combination of recyclable materials, including the inks and adhesives, and is not a laminate of dissimilar materials which are not recyclable. Furthermore, the compactness of the sock hanger 10 reduces the amount of packaging material required for shipping the product to the retailers, and thus provides an additional savings in materials and natural resources. The clear release liner 12, designed for automatic application by the product manufacturer, is also recyclable.

The adhesive 15 may also be other than hot melt adhesive if it has similar peel resistance. Although water soluble inks were used in a preferred embodiment, other types of inks, including solvent based inks may be used.

While the invention has been explained with respect to a preferred embodiment thereof, it is contemplated that various changes may be made in the invention without departing from the spirit and scope thereof.

What is claimed is:

1. A hanging system for suspending a product from a single wire hanger or a double wire hanger comprising:

a flat sheet of face stock, having a front side and a back side, said flat sheet divided into a hanger portion, a tab portion and a wrap portion, an image of a billboard containing graphics printed on said front side, an adhering region having a coating of pressure sensitive adhesive on said back side, a plurality of score lines dividing said face stock into said hanger portion, said tab portion and said wrap portion, a hanging region on said hanger portion, said hanging region having two parts, each of said parts having an opening for engaging a single or a double hanger wire, and being scored at a midpoint between said openings and folded over and joined to form said hanging region into a single product hanger, said tab portion being folded on, a first of said score lines and adhered to two pairs of the product, said hanger portion also being adhered to said two pairs of the product, and said wrap portion being folded on a second of said score lines, wrapped snugly around said two pairs of the product and adhered to said tab portion, said wrap portion being further wrapped snugly around a third pair of the product, and adhered to itself at point a circumferentially beyond said hanging region, thereby completely encircling said product and containing said product firmly within said face stock with said pressure sensitive adhesive.

2. The hanging system of claim 1 wherein said face stock is formed from a 10 point clay coated, white solid-bleached sulfate paperboard, and said pressure sensitive adhesive is a clear, permanent, hot melt adhesive designed for temporary adhesion to cotton, nylon, and similar fabrics.

3. The hanging system of claim 1 wherein the three pairs of the product are three pairs of men's socks.

* * * * *